US010920426B2

(12) United States Patent
Lu

(10) Patent No.: US 10,920,426 B2
(45) Date of Patent: Feb. 16, 2021

(54) OUTDOOR CANOPY WITH TARPAULIN DRAWING ADJUSTMENT STRUCTURE

(71) Applicant: Zhejiang Tianji Leisure Products CO., LTD, Zhejiang (CN)

(72) Inventor: Rongjie Lu, Zhejiang (CN)

(73) Assignee: Zhejiang Tianji Leisure Products CO., LTD, Zhejiang (CN)

( * ) Notice: Subject to any disclaimer, the term of this patent is extended or adjusted under 35 U.S.C. 154(b) by 0 days.

(21) Appl. No.: 16/503,492

(22) Filed: Jul. 4, 2019

(65) Prior Publication Data

US 2021/0002903 A1 Jan. 7, 2021

(51) Int. Cl.

| | |
|---|---|
| ***E04F 10/02*** | (2006.01) |
| ***E04H 15/58*** | (2006.01) |
| ***E04H 15/60*** | (2006.01) |
| ***E04H 15/64*** | (2006.01) |
| ***E04H 15/34*** | (2006.01) |
| ***E04H 15/32*** | (2006.01) |

(52) U.S. Cl.

CPC ..... *E04F 10/02* (2013.01); *E04H 15/322* (2013.01); *E04H 15/34* (2013.01); *E04H 15/58* (2013.01); *E04H 15/60* (2013.01); *E04H 15/64* (2013.01)

(58) Field of Classification Search

CPC ..... E04H 15/34; E04H 15/54; E04H 15/646; E04H 15/648; E04H 15/58; E04H 15/08; E04H 15/32; E04H 15/64; E04H 15/322; E04F 10/02

USPC ..... 135/114, 117, 119, 120.4, 121–123, 157, 135/120.3, 909

See application file for complete search history.

(56) References Cited

U.S. PATENT DOCUMENTS

| | | | | |
|---|---|---|---|---|
| 6,152,156 | A * | 11/2000 | Tung | A45B 17/00 135/20.1 |
| 6,478,037 | B2 * | 11/2002 | Tung | A45B 23/00 135/20.1 |
| 6,694,993 | B2 * | 2/2004 | Chou | A45B 23/00 135/98 |
| 7,600,734 | B2 * | 10/2009 | Clarke | A45B 25/00 135/120.3 |
| 7,753,064 | B2 * | 7/2010 | Sy-Facunda | E04H 15/14 135/131 |
| 7,766,755 | B2 * | 8/2010 | Werner | E04H 15/58 135/127 |
| 8,776,810 | B2 * | 7/2014 | Lah | A45B 9/00 135/75 |
| 8,832,910 | B2 * | 9/2014 | Lah | A63C 11/221 24/457 |
| 9,103,138 | B2 * | 8/2015 | Lovley, II | E04H 15/34 |
| 10,214,938 | B2 * | 2/2019 | Pan | E04H 15/54 |

(Continued)

*Primary Examiner* — Adriana Figueroa
(74) *Attorney, Agent, or Firm* — JCIP Global Inc.

(57) ABSTRACT

The present invention discloses an outdoor canopy having a tarpaulin drawing adjustment structure. The outdoor canopy includes a canopy frame and a tarpaulin. The canopy frame includes a column, longitudinal beams and horizontal beams. The tarpaulin is disposed on the horizontal beams and hanging from an outermost one of the horizontal beams. Both ends of the tarpaulin are provided with a tarpaulin-passing sleeve, and the tarpaulin-passing sleeve is provided inside with a tarpaulin-passing tube. A sliding mechanism for adjusting a drawing position of the tarpaulin is disposed between both ends of the tarpaulin-passing tube and the column.

5 Claims, 5 Drawing Sheets

(56) References Cited

U.S. PATENT DOCUMENTS

| | | | | |
|---|---|---|---|---|
| 2005/0126612 | A1* | 6/2005 | Chen | A45B 9/00<br>135/16 |
| 2006/0169311 | A1* | 8/2006 | Hwang | E04H 15/50<br>135/142 |
| 2016/0289997 | A1* | 10/2016 | Glatz | A45B 23/00 |
| 2019/0292808 | A1* | 9/2019 | Dotterweich | E04H 15/32 |

* cited by examiner

OUTDOOR CANOPY WITH TARPAULIN DRAWING ADJUSTMENT STRUCTURE

BACKGROUND

Technical Field

The present invention belongs to the technical field of outdoor canopy, in particular, to an outdoor canopy with tarpaulin drawing adjustment structure.

Description of Related Art

The outdoor canopy is a house substitute that is fixed on the ground for temporary use. It has a sunshade and rainproof function. Therefore, it is widely used in camping, exhibition halls, factories, temporary meetings, disaster relief and other fields in daily life. For the existing outdoor canopy, usually the tarpaulin is fixed, the flexibility of use is low, and the position of the tarpaulin cannot be adjusted according to different situations. At the same time, the existing outdoor canopy structure is complicated with troublesome assembly, and it is necessary to be familiar with the architecture in order to assemble. When assembling, many people are required to cooperate for a common assembly, especially for assembling the tarpaulin, resulting in being very troublesome to fix and restricts its promotion.

SUMMARY

In view of the problems existing in the prior art, it is an object of the present invention to provide an outdoor canopy with tarpaulin drawing adjustment structure.

The present invention is implemented by the following technical solutions.

The outdoor canopy has a tarpaulin drawing adjustment structure. The outdoor canopy includes a canopy frame and a tarpaulin. The canopy frame includes a column, two longitudinal beams disposed at a top end of the column, and a plurality of horizontal beams uniformly fixed on the two longitudinal beams. The tarpaulin is disposed on the horizontal beams and hanging from an outermost one of the horizontal beams. Both ends of the tarpaulin are provided with a tarpaulin-passing sleeve, and the tarpaulin-passing sleeve is provided inside with a tarpaulin-passing tube. A sliding mechanism for adjusting a drawing position of the tarpaulin is disposed between both ends of the tarpaulin-passing tube and the column. The outdoor canopy may achieve the overall drawing of the tarpaulin to achieve the purpose of tarpaulin adjustment.

In the present invention, the sliding mechanism includes a fixing sleeve tube, a vertical rod, and a sliding quick release. The fixing sleeve tube is disposed at upper and lower ends of a corresponding inner side of each column. Both ends of the vertical rod are respectively fixed in the fixing sleeve tube. The sliding quick release includes a sliding sleeve cylinder, and a connecting tube disposed perpendicular to the sliding sleeve cylinder. The sliding sleeve cylinder is sleeved on the vertical rod, and the connecting tube is cooperatively connected with an end portion of the tarpaulin-passing tube. The provision of the sliding quick release serves to connect the tarpaulin-passing tube and the vertical rod, and the sliding quick release moves up and down along the vertical rod, thereby driving the tarpaulin to move up and down.

In the present invention, the sliding quick release is further provided with a locking mechanism including a wrench, two wrench fixing brackets, and a locking tongue. The wrench fixing bracket is correspondingly fixed on a cylinder wall of the sliding sleeve cylinder. The wrench includes a wrench span and a round bump that are integrally formed as one piece. An eccentric connection is realized between the round bump and the fixing bracket through a pin shaft. The locking tongue is a square piece cut from a side wall of the sliding sleeve cylinder. Gaps are left between a lower side of the square piece and the side wall of the sliding sleeve cylinder and between left and right sides of the square piece and the side wall of the sliding sleeve cylinder. The specific structure of the locking mechanism realizes sliding or fixing of the sliding quick release on the vertical rod.

In the present invention, outer sides of the two of the horizontal beams at an edge portion are provided with a tarpaulin positioning rod. Both ends of the tarpaulin positioning rod are fixedly disposed with the longitudinal beam, and a gap is left between the tarpaulin positioning rod and the horizontal beams for the tarpaulin to pass therethrough.

In the present invention, a middle portion of the tarpaulin-passing sleeve is hollowed to form a hollow portion, and at least one tarpaulin-passing tube is sleeved in the tarpaulin-passing sleeve through the hollow portion. The provision of the hollow portion is convenient for installation.

In the present invention, a reinforcing rib is disposed between the column and the longitudinal beam.

In the present invention, the connecting tube is in threaded connection with the tarpaulin-passing tube.

The present invention may change the way that the tarpaulin of traditional outdoor canopy is fixed by the sliding quick release provided, and may adjust the position of the tarpaulin according to the situation, and the use is flexible. At the same time, the overall structure is simple and practical, and the assembly is convenient and quick.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

The present invention will be further described in detail below with reference to the accompanying drawings, and specific embodiments thereof.

Figure 1:
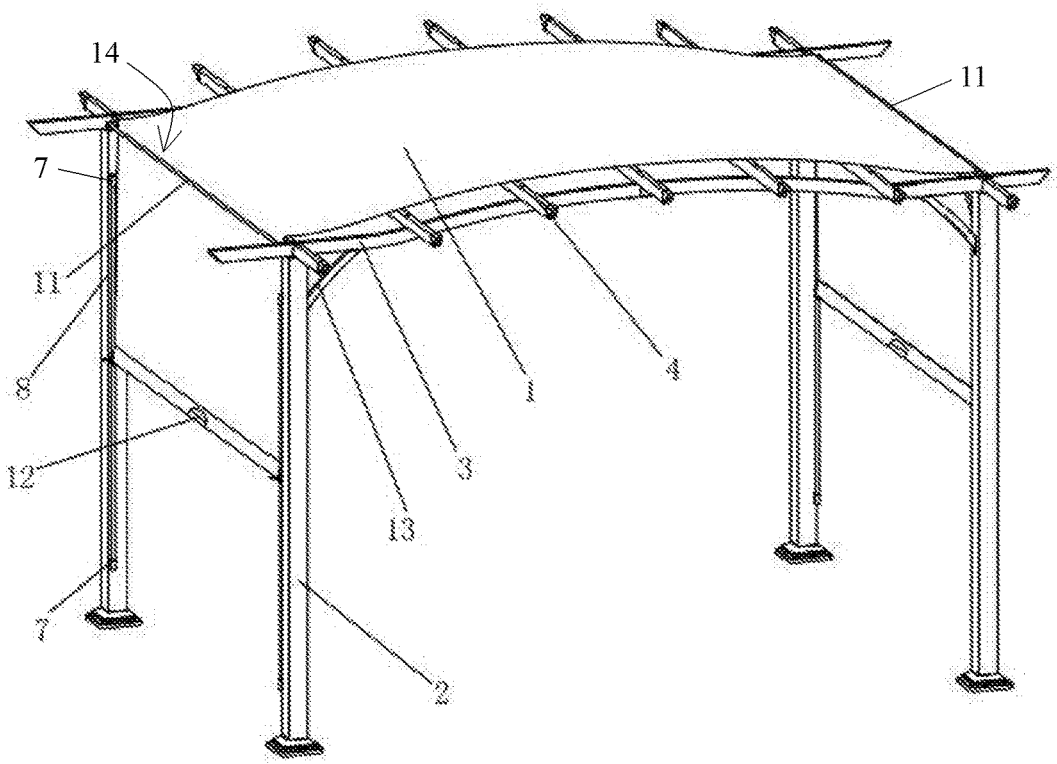
FIG. 1 is a view of an overall structure of the present invention.
Figure 2:
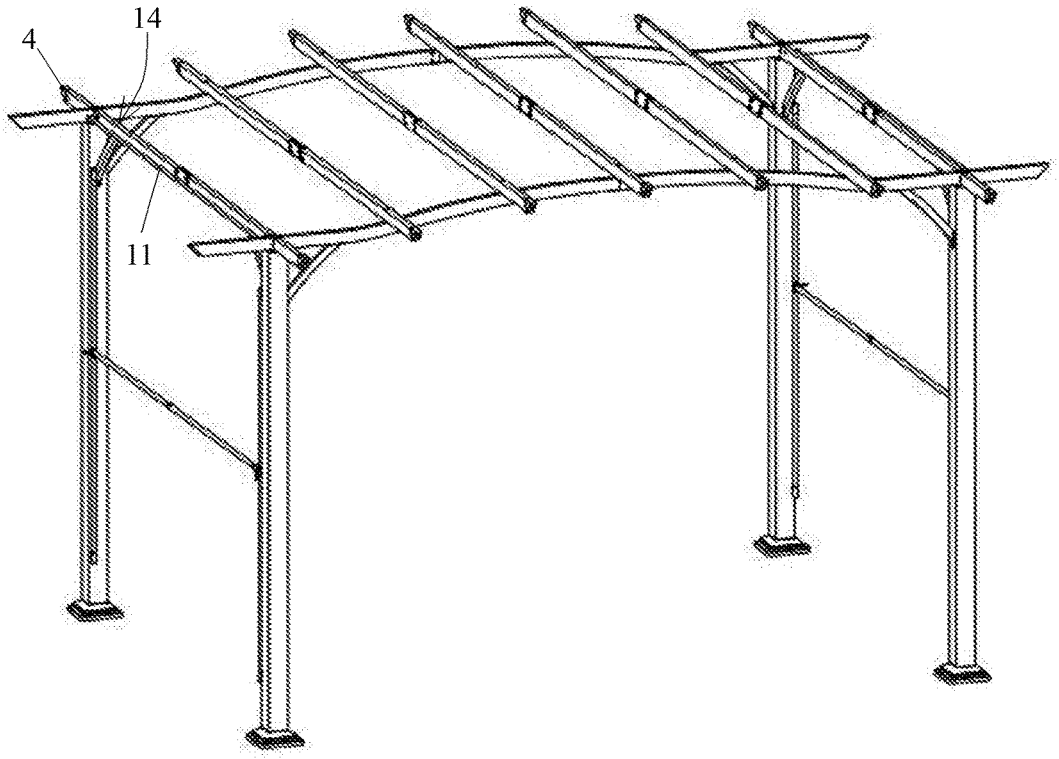
FIG. 2 is a view of the structure of FIG. 1 after a tarpaulin is removed.

As shown in FIG. 1 and FIG. 2, an outdoor canopy has a tarpaulin drawing adjustment structure. In the present invention, the outdoor canopy comprises a canopy frame and a tarpaulin 1. The canopy frame includes four columns 2, two longitudinal beams 3 disposed at a top end of the columns 2, and a plurality of horizontal beams 4 uniformly fixed on the two longitudinal beams 3. The column 2 is the main support structure for the entire product. In order to better support the tarpaulin 1, column legs with a circular or square structure may be disposed under the column 2. The column legs are made of plastic, rubber or other materials, and the column legs may also adopt the traditional rotating bolt structure to adjust the balance of the four columns 2 to prevent problems caused by uneven ground. A middle portion of the longitudinal beam 3 may be arched to ensure that the structure is more rigid and not easy to bend and deform. The horizontal beams 4 serve to reinforce a canopy roof and avoid the separation between the longitudinal beams 3, and a number of horizontal beams 4 is related to a length of the longitudinal beams 3. The tarpaulin 1 is disposed on the horizontal beams 4 and hanging from an outermost one of the horizontal beams 4. Both ends of the tarpaulin 1 are provided with a tarpaulin-passing sleeve 5, and the tarpaulin-passing sleeve 5 is provided inside with a tarpaulin-passing tube 6. A sliding mechanism for adjusting a drawing position of the tarpaulin 1 is disposed between both ends of the tarpaulin-passing tube 6 and the column 2. The sliding mechanism is configured to adjust the position of the tarpaulin 1 overall.

Figure 8:
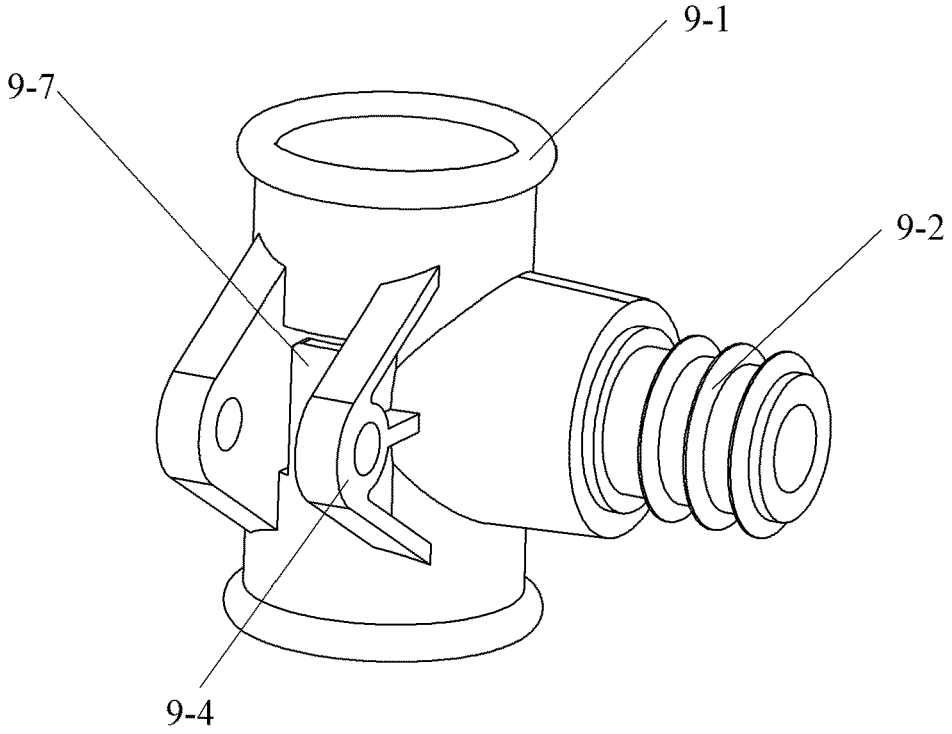
FIG. 8 is a view showing a sliding sleeve a cylinder and a connecting tube of the sliding quick release.
Figure 9:
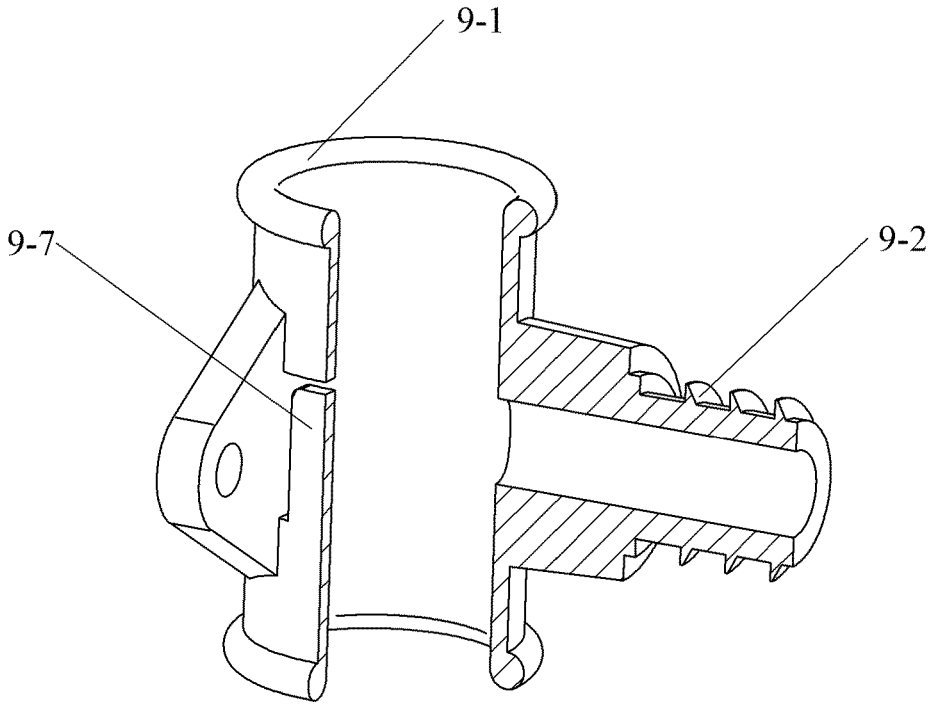
FIG. 9 is a partial sectional view of FIG. 8.

As shown in FIG. 3 to FIG. 7, the sliding mechanism includes a fixing sleeve tube 7, a vertical rod 8, and a sliding quick release 9. The fixing sleeve tube 7 is disposed at upper and lower ends of a corresponding inner side of each of the columns 2. Both ends of the vertical rod 8 are respectively fixed in the fixing sleeve tube 7. The sliding quick release 9 includes a sliding sleeve cylinder 9-1 and a connecting tube 9-2 disposed perpendicular to the sliding sleeve cylinder 9-1. The sliding sleeve cylinder 9-1 is sleeved on the vertical rod 8, and the connecting tube 9-2 is in threaded connection with an end portion of the tarpaulin-passing tube 6. In order to adjust and fix the position of the tarpaulin 1, the sliding quick release 9 is further provided with a locking mechanism including a wrench 9-3, a wrench fixing bracket 9-4, and a locking tongue 9-7. The two wrench fixing brackets 9-4 are fixed on a cylinder wall of the sliding sleeve cylinder 9-1. The wrench 9-3 includes a wrench span 9-5 and a round bump 9-6 that are integrally formed as one piece. An eccentric connection is realized between the round bump 9-6 and the fixing bracket 9-4 through a pin shaft 10. As shown in FIG. 8 and FIG. 9, the locking tongue 9-7 is a square piece cut from a side wall of the sliding sleeve cylinder 9-1. Gaps are left between a lower side of the square piece and the side wall of the sliding sleeve cylinder 9-1 and between left and right sides of the square piece and the side wall of the sliding sleeve cylinder 9-1.

As shown in FIG. 1 to FIG. 5, outer sides of the two horizontal beams 4 at an edge portion are provided with a tarpaulin positioning rod 11. Both ends of the tarpaulin positioning rod 11 are fixedly disposed with the longitudinal beam 3, and a gap 14 is left between the tarpaulin positioning rod 11 and the horizontal beam 4 for the tarpaulin 1 to pass therethrough. This provision prevents the tarpaulin 1 from being blown out of the roof frame by the wind. By adding the tarpaulin positioning rod 11, the structure is simple and the installation is convenient, and the function of using traditional tarpaulin as a hook is achieved.

Figure 3:
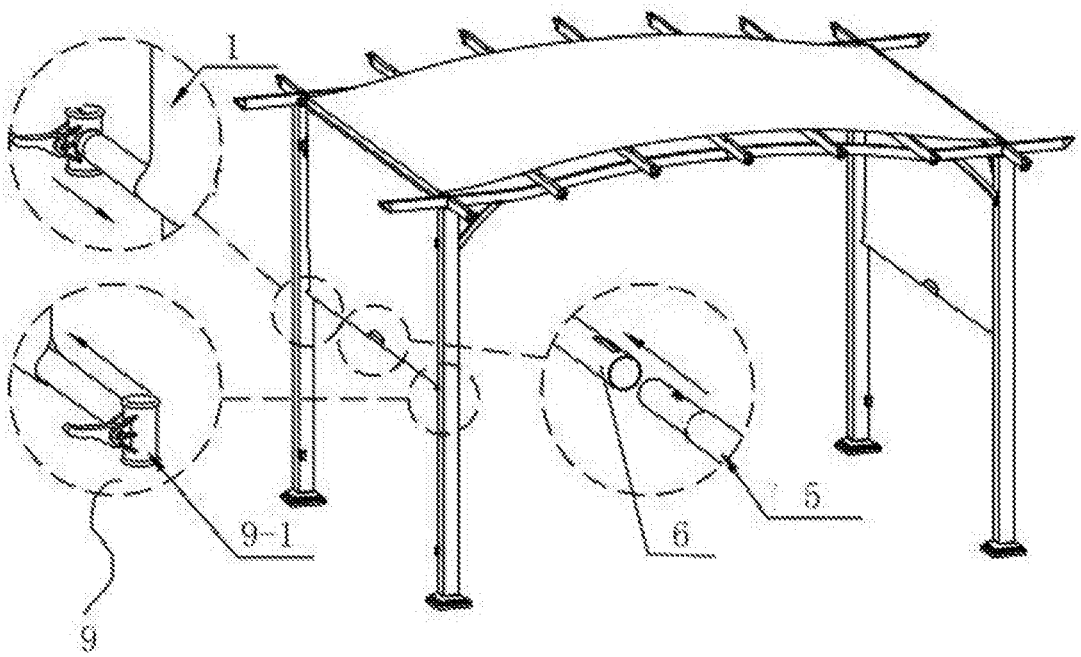
FIG. 3 to FIG. 5 are partial enlarged views of different portions of the outdoor canopy.
Figure 4:
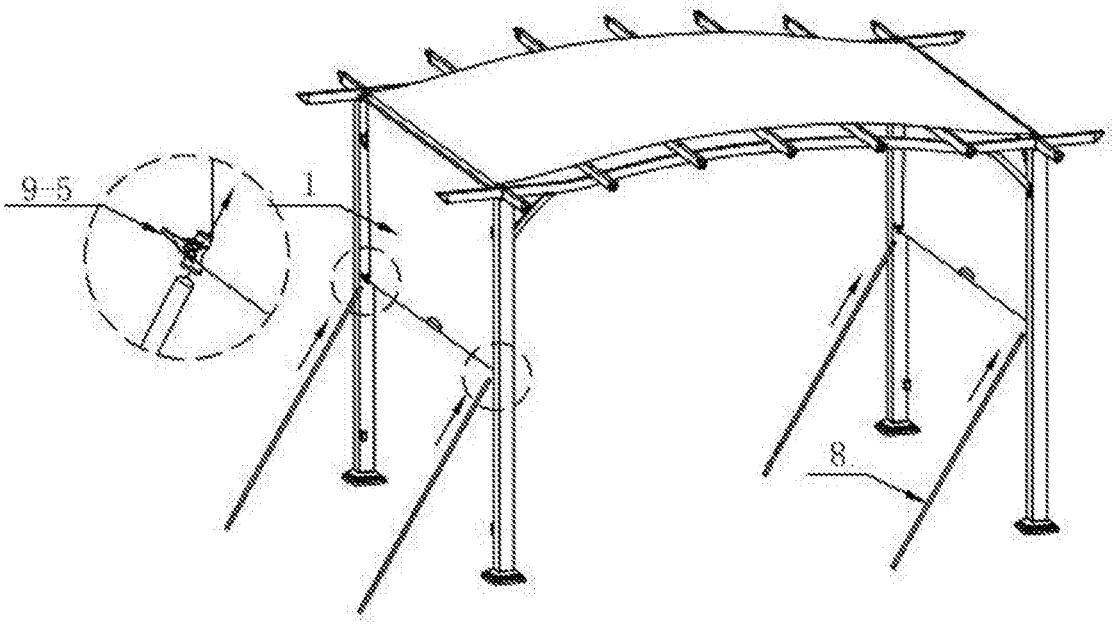
Figure 5:
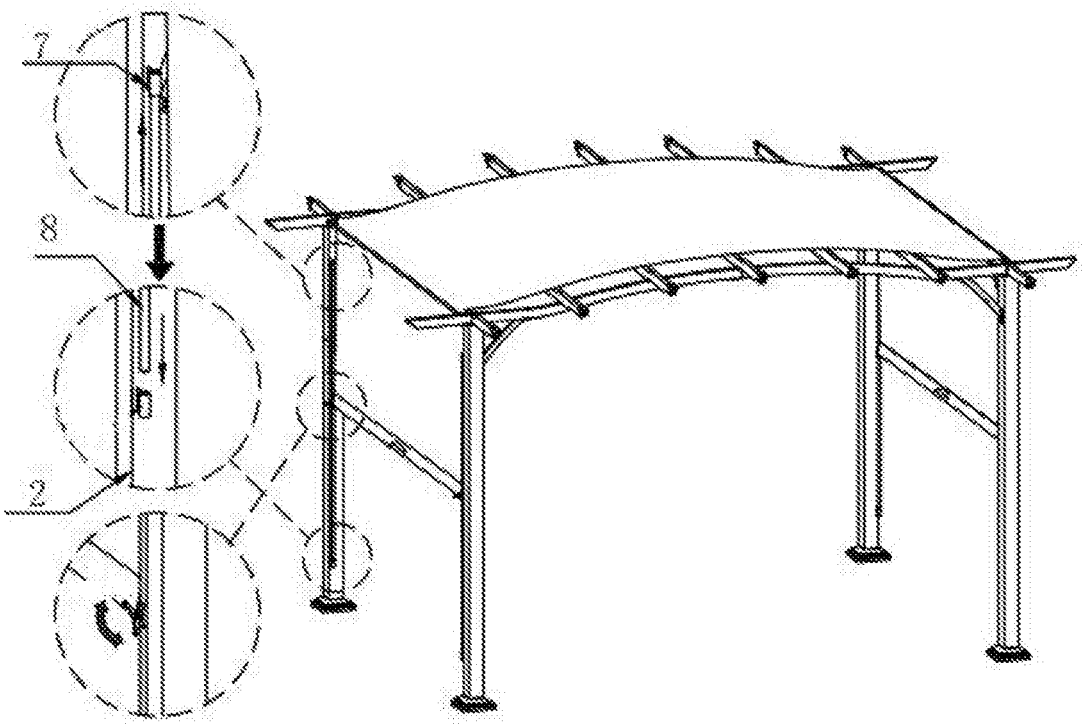
Figure 6:
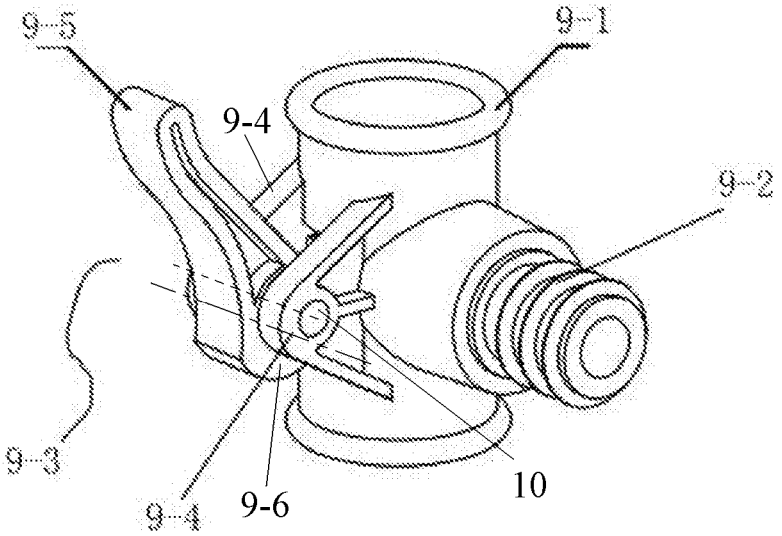
FIG. 6 is a view of the overall structure of a sliding quick release.
Figure 7:
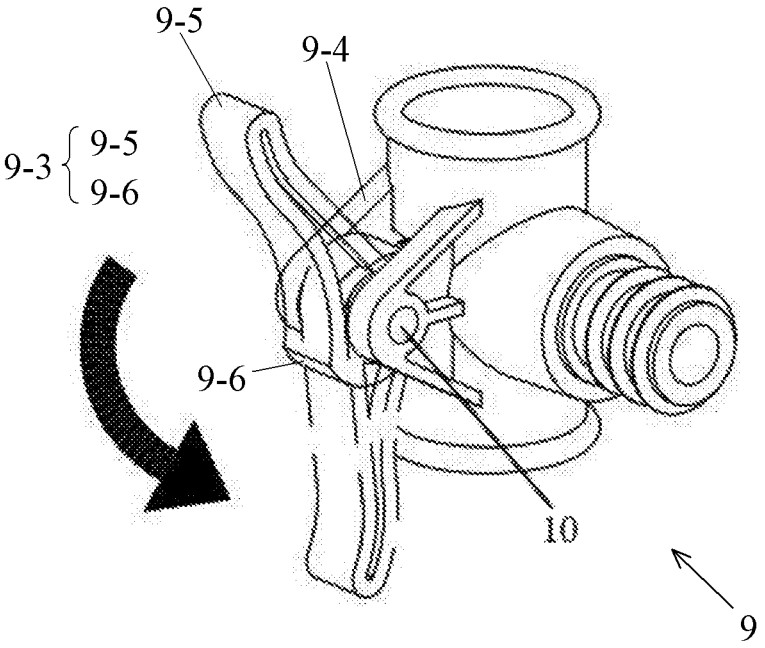
FIG. 7 is a view showing the structure of different wrenches at different positions.

As shown in FIG. 3, a middle portion of the tarpaulin-passing sleeve 5 is hollowed to form a hollow portion 12, and at least one tarpaulin-passing tube 6 is sleeved in the tarpaulin-passing sleeve 5 through the hollow portion 12. The provision of the hollow portion 12 is convenient for installation. In addition, in order to improve the firmness of the overall structure, a reinforcing rib 13 is disposed between the column 2 and the longitudinal beams 3.

The working process of the sliding quick release 9 of the present invention is as follows. When it is necessary to fix the tarpaulin position, after moving the wrench 9-3 into place as shown in the dotted line in FIG. 7, the eccentric function of the wrench 9-3 will squeeze the locking tongue 9-7 on a main body of the quick release, so that a free end of the locking tongue 9-7 moves inward for achieving the pressing of the vertical rod 8, thereby achieving the tightening function. When the position of the tarpaulin 1 has to be re-adjusted, the wrench 9-3 is moved up, and the round bump 9-6 is disengaged from the locking tongue 9-7 by the eccentricity, then the locking tongue 9-7 rebounds to its original position away from the vertical rod 8, so that the sliding quick release 9 is unlocked, and then the sliding quick release 9 is moved up and down to drive the overall movement of the tarpaulin 1 to achieve the purpose of tarpaulin adjustment. After adjusting the position, the wrench 9-3 is pressed to fix the position of the tarpaulin 1. This adjustment process is quick and easy.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An outdoor canopy having a tarpaulin drawing adjustment structure, the outdoor canopy comprising a canopy frame, and a tarpaulin, the canopy frame including four columns, two longitudinal beams disposed at a top end of the corresponding columns, and a plurality of horizontal beams uniformly fixed on the two longitudinal beams, the tarpaulin being disposed on the horizontal beams and hanging from an outermost one of the horizontal beams, both ends of the tarpaulin being provided with a tarpaulin-passing sleeve, and the tarpaulin-passing sleeve being provided inside with a tarpaulin-passing tube, wherein a sliding mechanism for adjusting a drawing position of the tarpaulin is disposed between both ends of the tarpaulin-passing tube and the corresponding column, wherein the sliding mechanism includes a sliding quick release, and the sliding quick release includes a sliding sleeve cylinder slidable along each column; and wherein the sliding quick release is further provided with a locking mechanism including a wrench, two wrench fixing brackets, and a locking tongue, the two wrench fixing brackets being correspondingly fixed on a cylinder wall of the sliding sleeve cylinder; the wrench includes a wrench span and a round bump that are integrally formed as one piece, an eccentric connection being realized between the round bump and the wrench fixing bracket through a pin shaft; the locking tongue is a square piece cut from a side wall of the sliding sleeve cylinder, gaps being left between a lower side of the square piece and the side wall of the sliding sleeve cylinder and between left and right sides of the square piece and the side wall of the sliding sleeve cylinder;

wherein the sliding mechanism further includes a fixing sleeve tube and a vertical rod, the fixing sleeve tube being disposed at upper and lower ends of a corresponding inner side of each column, both ends of the vertical rod being respectively fixed in the fixing sleeve tube; the sliding quick release further includes a connecting tube disposed perpendicular to the sliding sleeve cylinder, the sliding sleeve cylinder being sleeved on the vertical rod, and the connecting tube being cooperatively connected with an end portion of the tarpaulin-passing tube.

2. The outdoor canopy according to claim 1, wherein outer sides of the two of the horizontal beams at an edge portion are provided with a tarpaulin positioning rod; both ends of the tarpaulin positioning rod are fixedly disposed with the longitudinal beam, and a gap is left between the tarpaulin positioning rod and the horizontal beams for the tarpaulin to pass therethrough.

3. The outdoor canopy according to claim 1, wherein a middle portion of the tarpaulin-passing sleeve is hollowed to form a hollow portion, and the tarpaulin-passing tube is sleeved in the tarpaulin-passing sleeve through the hollow portion.

4. The outdoor canopy according to claim 1, wherein a reinforcing rib is disposed between the column and the longitudinal beam.

5. The outdoor canopy according to claim 1, wherein the connecting tube is in threaded connection with the tarpaulin-passing tube.

* * * * *